US010060298B2

(12) United States Patent
Takahashi et al.

(10) Patent No.: US 10,060,298 B2
(45) Date of Patent: Aug. 28, 2018

(54) THERMAL ENERGY RECOVERY DEVICE AND START-UP METHOD THEREOF

(71) Applicant: Kobe Steel, Ltd., Kobe-shi, Hyogo (JP)

(72) Inventors: Kazuo Takahashi, Kobe (JP); Shigeto Adachi, Takasago (JP); Yutaka Narukawa, Takasago (JP); Eiji Kanki, Hyogo (JP); Shirohiko Okamoto, Hyogo (JP)

(73) Assignee: Kobe Steel, Ltd., Hyogo (JP)

( * ) Notice: Subject to any disclaimer, the term of this patent is extended or adjusted under 35 U.S.C. 154(b) by 81 days.

(21) Appl. No.: 15/186,094

(22) Filed: Jun. 17, 2016

(65) Prior Publication Data

US 2017/0016353 A1 Jan. 19, 2017

(30) Foreign Application Priority Data

Jul. 16, 2015 (JP) ..... 2015-142172
Mar. 7, 2016 (JP) ..... 2016-043139

(51) Int. Cl.
*F01K 13/02* (2006.01)
*F01K 9/04* (2006.01)
*F01K 9/02* (2006.01)

(52) U.S. Cl.
CPC ..... *F01K 13/02* (2013.01); *F01K 9/023* (2013.01); *F01K 9/04* (2013.01)

(58) Field of Classification Search
CPC ..... F01K 13/02; F01K 9/04; F01K 9/023
USPC ..... 60/641.1–641.15, 653
See application file for complete search history.

(56) References Cited

U.S. PATENT DOCUMENTS 3,953,966 A * 5/1976 Martz ..... F01K 13/02 60/39.182
5,724,814 A * 3/1998 Ven ..... F01B 17/00 60/618
5,946,916 A 9/1999 Ven et al.
6,076,355 A 6/2000 Ven et al.
8,955,320 B2 * 2/2015 Xiang ..... C09K 5/063 165/10
2007/0245737 A1 * 10/2007 Inaba ..... B60H 1/00885 60/670

(Continued)

FOREIGN PATENT DOCUMENTS

CN 1130932 A 9/1996
JP 2006-037760 A 2/2006

(Continued)

*Primary Examiner* — Hoang Nguyen
(74) *Attorney, Agent, or Firm* — Studebaker & Brackett PC

(57) ABSTRACT

A thermal energy recovery device capable of suppressing a rapid increase of thermal stress generated in an evaporator when the operation is started and a start-up method thereof are provided. The thermal energy recovery device includes an evaporator, a preheater, an energy recovery unit, a circulating flow path, a pump, a heating medium flow path for supplying a heating medium to the evaporator and the preheater, a flow adjustment unit provided in a portion on the upstream side than the evaporator within the heating medium flow path, and a control unit. The control unit controls the flow adjustment unit so that the inflow amount of the heating medium in a gas-phase to the evaporator gradually increases, in a state that the pump is stopped, until the temperature of the evaporator becomes a specified value.

14 Claims, 4 Drawing Sheets

(56) References Cited

U.S. PATENT DOCUMENTS

| | | | | |
|---|---|---|---|---|
| 2014/0260246 | A1* | 9/2014 | Fisher | F03G 7/04<br>60/641.2 |
| 2015/0122202 | A1* | 5/2015 | Heim | F01K 13/02<br>122/504 |

FOREIGN PATENT DOCUMENTS

| | | | |
|---|---|---|---|
| JP | 2014-047632 | A | 3/2014 |
| KR | 2011-0079449 | A | 7/2011 |

* cited by examiner

THERMAL ENERGY RECOVERY DEVICE AND START-UP METHOD THEREOF

BACKGROUND OF THE INVENTION

Field of the Invention

The present invention relates to a thermal energy recovery device and a start-up method thereof.

Description of the Related Art

Conventionally, a thermal energy recovery device for recovering power from a heating medium such as an exhaust gas discharged from various facilities of a factory is known. For example, JP 2014-47632 A discloses a power generating device (thermal energy recovery device) including an evaporator for heating a working medium by a heating medium supplied from an external heat source, a preheater for heating the working medium before flowing into the evaporator by the heating medium flowing out of the evaporator, an expander for expanding the working medium flowing out of the evaporator, a generator connected to the expander, a condenser for condensing the working medium flowing out of the expander, a working medium pump for sending the working medium condensed by the condenser to the preheater, and a circulating flow path for connecting the preheater, the evaporator, the expander, the condenser, and the pump.

In the thermal energy recovery device described in the above JP 2014-47632 A, in a case where steam (a medium in a gas phase) is supplied to the evaporator as the heating medium, it is concerned that the temperature of the evaporator rises suddenly when the operation of the device is started and thereby thermal stress generated in the evaporator is increased rapidly. Concretely, before the operation of the device is started, while the temperature of the evaporator is relatively low, the thermal energy that a heating medium in a gas phase such as steam has is very large, and therefore if the high temperature heating medium in a gas phase flows into the evaporator when the operation is started, it is feared that the temperature of the evaporator rises suddenly.

SUMMARY OF THE INVENTION

An object of the invention is to provide a thermal energy recovery device capable of suppressing a rapid increase of thermal stress generated in an evaporator when the operation is started and a start-up method thereof.

As a means for solving the above problem, the present invention provides a thermal energy recovery device including: an evaporator for evaporating a working medium by allowing a heating medium in a gas phase supplied from the outside and the working medium to exchange heat therebetween; a preheater for heating the working medium by allowing the heating medium flowing out of the evaporator and the working medium before flowing into the evaporator to exchange heat therebetween; an energy recovery unit for recovering energy from the working medium flowing out of the evaporator; a circulating flow path for connecting the preheater, the evaporator, and the energy recovery unit and for allowing the working medium to flow; a pump provided in the circulating flow path; a heating medium flow path for supplying the heating medium to the evaporator and the preheater; a flow adjustment unit provided in a portion on the upstream side than the evaporator within the heating medium flow path; and a control unit, in which the control unit controls the flow adjustment unit so that the inflow amount of the heating medium in a gas phase to the evaporator gradually increases, in a state that the pump is stopped, until the temperature of the evaporator becomes a specified value.

In the present thermal energy recovery device, the inflow amount of the heating medium in a gas phase (steam or the like) to the evaporator gradually increases until the temperature of the evaporator becomes the specified value, so a rapid rise of the temperature of the evaporator is suppressed. Further, the pump is stopped until the temperature of the evaporator becomes the specified value, so a rapid inflow of the heating medium to the evaporator, that is, a sudden rise of the temperature of the evaporator is suppressed more reliably. Concretely, if the pump is driven before the temperature of the evaporator becomes the specified value, the working medium flows into the evaporator and the heating medium in a gas phase is cooled by the working medium, so condensation of the heating medium in a gas phase in the evaporator is facilitated. When the heating medium in a gas phase is condensed, the volume (pressure) of the heating medium is reduced, so the inflow of the heating medium in a gas phase to the evaporator from the heating medium flow path is facilitated, and thereby the temperature of the evaporator may suddenly rise. In contrast, in the present device, the pump is stopped until the temperature of the evaporator becomes the specified value, so the sudden rise of the temperature of the evaporator when the operation is started, that is, the rapid increase of thermal stress generated in the evaporator is suppressed.

In this case, the control unit preferably increases the rotational speed of the pump so that the pressure of a portion between the flow adjustment unit and the evaporator within the heating medium flow path is maintained to be higher than the pressure of a portion on the downstream side than the preheater within the heating medium flow path when the temperature of the evaporator is the specified value.

In this way, it is possible to drive the pump (shift to a steady operation for recovering energy in the energy recovery unit) while suppressing the generation of a so-called water hammer phenomenon in the evaporator. For example, in a case where the pressure of the portion between the flow adjustment unit and the evaporator within the heating medium flow path is smaller than the pressure of the portion on the downstream side than the preheater within the heating medium flow path, the heating medium in a liquid phase condensed in the evaporator or the preheater becomes difficult to flow out of the preheater, and therefore the heating medium in a liquid phase is easy to accumulate within the evaporator. If the heating medium in a gas phase flows into the evaporator in this state, the heating medium is cooled and condensed by the heating medium in a liquid phase (drain or mist) within the evaporator and thereby its volume is rapidly reduced. So, the pressure of the region where the condensation of the heating medium occurs becomes relatively low. As a result, the heating medium in a liquid phase (droplet) moves toward the region where the pressure is relatively low, thereby a phenomenon (water hammer phenomenon) that the heating medium in a liquid phase collides with the inner surface of the evaporator may be generated. In contrast, in the present device, the pressure of the portion between the flow adjustment unit and the evaporator within the heating medium flow path is maintained to be higher than the pressure of the portion on the downstream side than the preheater within the heating medium flow path, so the generation of the water hammer phenomenon in the evaporator is suppressed.

Moreover, in the present invention, preferably, a steam trap provided in a portion on the downstream side than the evaporator and on the upstream side than the preheater within the heating medium flow path is further included, and the steam trap prohibits the passage of the heating medium in a gas phase and permits the passage of the heating medium in a liquid phase among the heating medium flowing out of the evaporator.

In this aspect, even if the heating medium flows out of the evaporator in a gas phase or a gas-liquid two-phase state, the passage of the heating medium in a gas phase is prohibited by the steam trap, so the inflow of the heating medium in a gas phase into the preheater is suppressed. Therefore, the generation of the water hammer phenomenon in the preheater is suppressed.

In this case, a gas venting flow path that is provided in a portion between the steam trap and the preheater within the heating medium flow path and discharges the heating medium in a gas phase among the heating medium flowing out of the evaporator to the outside is preferably further included.

In this way, the inflow of the heating medium in a gas phase into the preheater is suppressed more reliably.

Moreover, in the present invention, preferably, the flow adjustment unit has a first on-off valve provided in the portion on the upstream side than the evaporator within the heating medium flow path, a bypass flow path that bypasses the first on-off valve and has an inner diameter smaller than the inner diameter of the heating medium flow path, and a second on-off valve provided in the bypass flow path, and the second on-off valve is configured adjustably in its opening.

In this aspect, by a simple structure of providing the bypass flow path having an inner diameter smaller than the inner diameter of the heating medium flow path and the second on-off valve adjustable in its opening, it is possible to make a fine adjustment of the inflow amount of the heating medium in a gas phase into the evaporator.

In this case, the control unit preferably opens the first on-off valve when the pressure of a portion on the upstream side than the flow adjustment unit within the heating medium flow path and the pressure of the portion between the flow adjustment unit and the evaporator within the heating medium flow path are equal to each other.

In this way, the inflow amount of the heating medium in a gas phase into the evaporator can be increased while suppressing a rapid inflow of the heating medium in a gas phase into the evaporator, that is, a sudden rise of the temperature of the evaporator when the first on-off valve is opened.

Moreover, in the present invention, preferably, a pressure loss generation unit is provided in the portion on the downstream side than the preheater within the heating medium flow path, and the pressure loss generation unit applies a pressure loss to the heating medium flowing out of the preheater so that the interior of the preheater is filled with the heating medium in a liquid phase.

In this way, the interior of the preheater is filled with the heating medium in a liquid phase, so the generation of the water hammer phenomenon in the preheater is suppressed.

Concretely, preferably, the pressure loss generation unit is formed of a rising flow path configured by a part of the heating medium flow path and having a shape rising upwardly, and a position of an end part on the downstream side of the rising flow path is set to a height position of the preheater equal to or higher than a height position of an inflow port that allows for the inflow of the heating medium into the preheater.

In this way, it is possible to easily cause a pressure loss to the heating medium flowing out of the preheater.

Moreover, in the present invention, preferably, an adjusting valve adjustable in its opening provided in the portion on the downstream side of the preheater within the heating medium flow path is further included, and the control unit adjusts the opening of the adjusting valve so that the temperature or the pressure of a portion on the downstream side than the adjusting valve within the heating medium flow path falls within a given range.

In this way, the temperature or the pressure of the heating medium flowing out of the preheater falls within the given range, so the heating medium can be effectively utilized.

Moreover, the present invention provides a thermal energy recovery device including: an evaporator for evaporating a working medium by allowing a heating medium in a gas phase supplied from the outside and the working medium to exchange heat therebetween; an energy recovery unit for recovering energy from the working medium flowing out of the evaporator; a circulating flow path for connecting the evaporator and the energy recovery unit and for allowing the working medium to flow; a pump provided in the circulating flow path; a heating medium flow path for supplying the heating medium to the evaporator; a flow adjustment unit provided in a portion on the upstream side than the evaporator within the heating medium flow path; and a control unit, in which the control unit controls the flow adjustment unit so that the inflow amount of the heating medium in a gas phase to the evaporator gradually increases, in a state that the pump is stopped, until the temperature of the evaporator becomes a specified value.

Also in the present thermal energy recovery device, the inflow amount of the heating medium in a gas phase (steam or the like) to the evaporator gradually increases until the temperature of the evaporator becomes the specified value, so a rapid rise of the temperature of the evaporator is suppressed. Further, the pump is stopped until the temperature of the evaporator becomes the specified value, so a rapid inflow of the heating medium to the evaporator, that is, a sudden rise of the temperature of the evaporator is suppressed more reliably.

In this case, preferably, the flow adjustment unit has a first on-off valve provided in the portion on the upstream side than the evaporator within the heating medium flow path, a bypass flow path that bypasses the first on-off valve and has an inner diameter smaller than the inner diameter of the heating medium flow path, and a second on-off valve provided in the bypass flow path, and the second on-off valve is configured adjustably in its opening.

Further, in this case, the control unit preferably opens the first on-off valve when the pressure of a portion on the upstream side than the flow adjustment unit within the heating medium flow path and the pressure of a portion between the flow adjustment unit and the evaporator within the heating medium flow path are equal to each other.

Moreover, the present invention provides a start-up method of a thermal energy recovery device, the thermal energy recovery device including: an evaporator for evaporating a working medium by allowing a heating medium in a gas phase supplied from the outside and the working medium to exchange heat therebetween; a preheater for heating the working medium by allowing the heating medium flowing out of the evaporator and the working medium before flowing into the evaporator to exchange heat therebetween; an energy recovery unit for recovering energy from the working medium flowing out of the evaporator; a circulating flow path for connecting the preheater, the evaporator, and the energy recovery unit and for allowing the working medium to flow; a pump provided in the circulating flow path; and a heating medium flow path for supplying the heating medium to the evaporator and the preheater, in which the method includes a heating medium supply starting step for starting the supply of the heating medium in a gas phase to the evaporator and the preheater, and in the heating medium supply starting step, the inflow amount of the heating medium in a gas phase to the evaporator gradually increases, in a state that the pump is stopped, until the temperature of the evaporator becomes a specified value.

In the present start-up method, a sudden rise of the temperature of the evaporator at the time of start-up (when the operation is started), that is, a rapid increase of thermal stress generated in the evaporator is suppressed.

In this case, preferably, a pump drive starting step for starting the drive of the pump is further included, and in the pump drive starting step, the rotational speed of the pump is increased so that the pressure of a portion between the flow adjustment unit and the evaporator within the heating medium flow path is maintained to be higher than the pressure of a portion on the downstream side than the preheater within the heating medium flow path when the temperature of the evaporator becomes the specified value.

In this way, it is possible to drive the pump (shift to a steady operation for recovering energy in the energy recovery unit) while suppressing the generation of a so-called water hammer phenomenon in the evaporator.

As described above, according to the present invention, it is possible to provide a thermal energy recovery device capable of suppressing a rapid increase of thermal stress generated in an evaporator when the operation is started and a start-up method thereof.

DESCRIPTION OF THE PREFERRED EMBODIMENTS (First Embodiment)

A thermal energy recovery device of a first embodiment of the present invention will be described with reference to FIG. 1 and FIG. 2.

Figure 1:
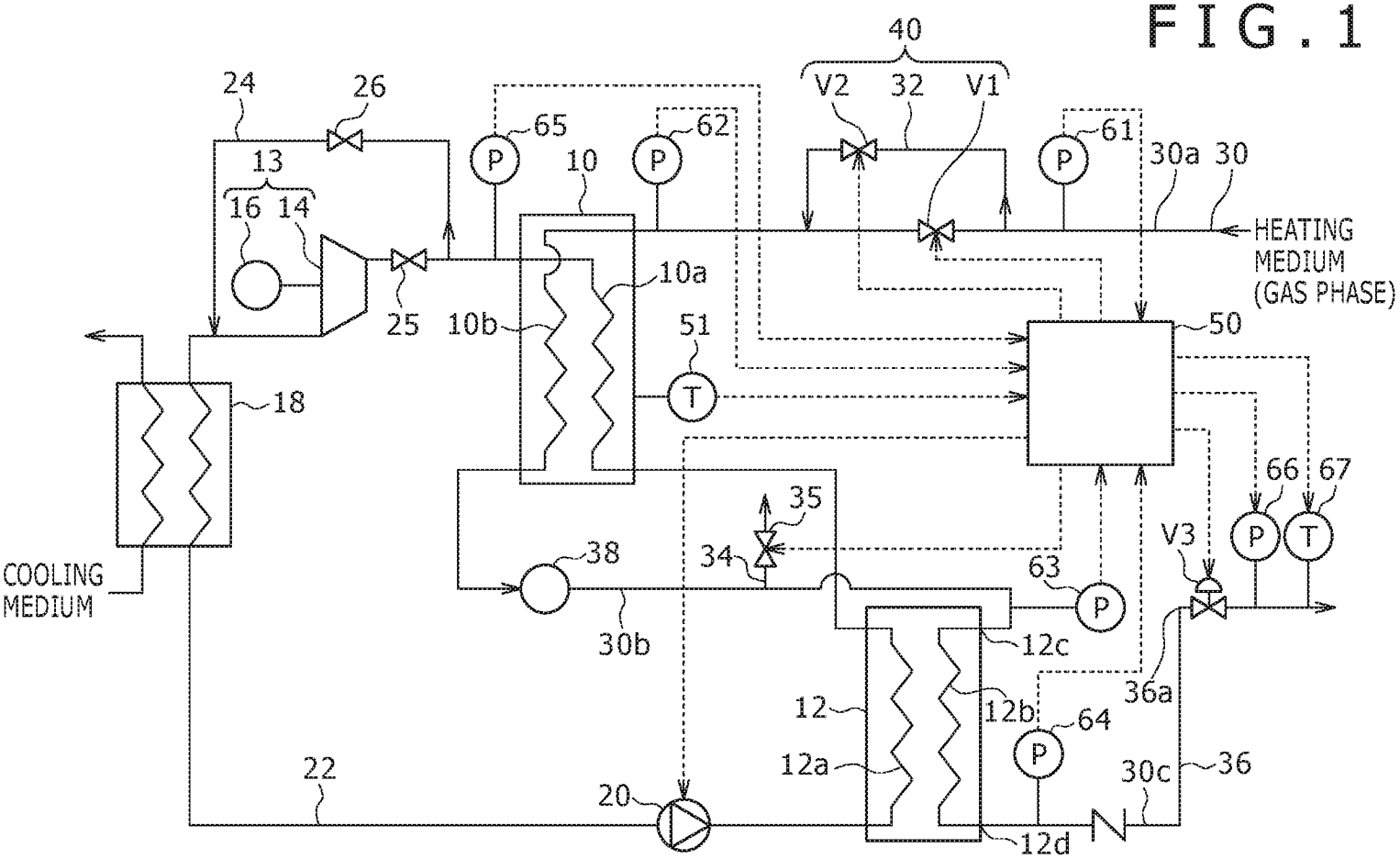
FIG. 1 is a diagram showing an outline of a configuration of a thermal energy recovery device of a first embodiment of the present invention.
Figure 2:
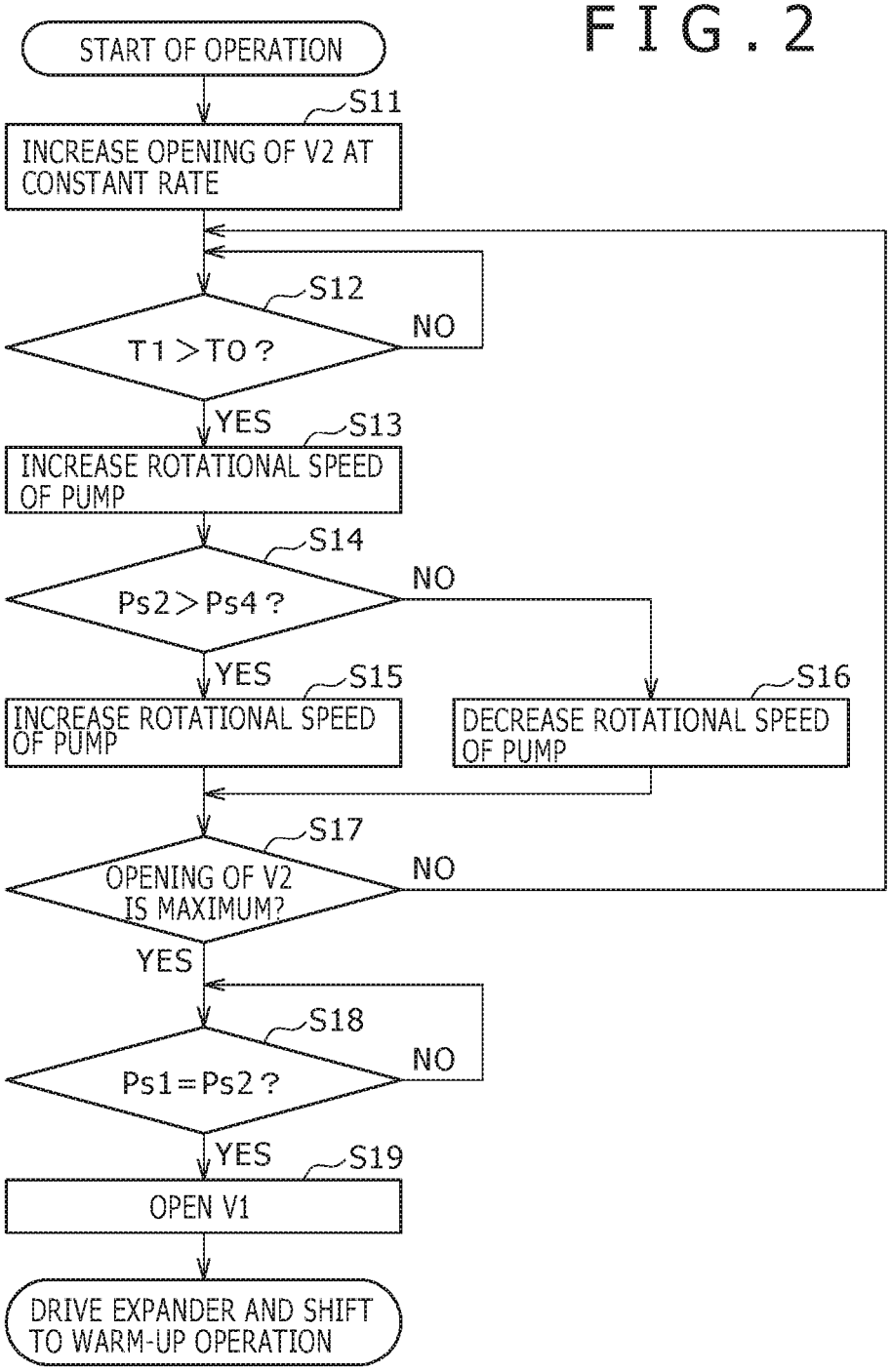
FIG. 2 is a flow chart showing control contents of a control unit at the time of start-up.

As shown in FIG. 1, the thermal energy recovery device comprises an evaporator 10, a preheater 12, an energy recovery unit 13, a condenser 18, a pump 20, a circulating flow path 22, a heating medium flow path 30, a flow adjustment unit 40, and a control unit 50.

The evaporator 10 evaporates a working medium by allowing a heating medium in a gas phase (an exhaust gas from a factory, or the like) supplied from the outside and the working medium (HFC245fa or the like) to exchange heat therebetween. The evaporator 10 has a first flow path 10*a* through which the working medium flows, and a second flow path 10*b* through which the heating medium flows. In the present embodiment, as the evaporator 10, a brazed plate type heat exchanger is used. However, as the evaporator 10, a so-called shell and tube type heat exchanger may be used.

The preheater 12 heats the working medium by allowing the heating medium flowing out of the evaporator 10 and the working medium before flowing into the evaporator 10 to exchange heat therebetween. The preheater 12 has a first flow path 12*a* through which the working medium flows, and a second flow path 12*b* through which the heating medium flows. In the present embodiment, also as the preheater 12, a brazed plate type heat exchanger is used. However, as with the case of the evaporator 10, as the preheater 12, a so-called shell and tube type heat exchanger may be used. The preheater 12 has an inflow port 12*c* that allows the inflow of the heating medium into the second flow path 12*b*, and an outflow port 12*d* that allows the outflow of the heating medium from the second flow path 12*b*. The preheater 12 is placed in such an attitude that a position of the inflow port 12*c* is higher than a position of the outflow port 12*d*. A height position of an end part on the upstream side of the second flow path 12*b* of the preheater 12 is set to be equal to or lower than a height position of an end part on the downstream side of the second flow path 10*b* of the evaporator 10.

The energy recovery unit 13 comprises an expander 14 and a power recovery machine 16. The circulating flow path 22 directly connects the preheater 12, the evaporator 10, the expander 14, the condenser 18, and the pump 20, in this order. In a portion between the evaporator 10 and the expander 14 within the circulating flow path 22, a shutoff valve 25 is provided. Moreover, in the circulating flow path 22, a detour flow path 24 detouring the expander 14 is provided. In the detour flow path 24, an on-off valve 26 is provided.

The expander 14 is provided in a portion on the downstream side of the evaporator 10 within the circulating flow path 22. The expander 14 expands the working medium in a gas phase flowing out of the evaporator 10. In the present embodiment, as the expander 14, a positive displacement screw expander having a rotor rotationally driven by an expansion energy of the working medium in a gas phase flowing out of the evaporator 10 is used. Concretely, the expander 14 has a pair of male and female screw rotors.

The power recovery machine 16 is connected to the expander 14. In the present embodiment, a generator is used as the power recovery machine 16. The power recovery machine 16 has a rotating shaft connected to one of the pair of screw rotors of the expander 14. The power recovery machine 16 generates an electric power by rotation of the rotating shaft in accordance with the rotation of the screw rotor. It should be noted that as the power recovery machine 16, a compressor or the like in addition to the generator may be used.

The condenser 18 is provided in a portion on the downstream side of the expander 14 within the circulating flow path 22. The condenser 18 condenses (liquefies) the working medium flowing out of the expander 14 by cooling with a cooling medium (a cooling water or the like) supplied from the outside.

The pump 20 is provided in a portion on the downstream side of the condenser 18 (a portion between the condenser 18 and the preheater 12) within the circulating flow path 22. The pump 20 pressurizes the working medium in a liquid phase to a predetermined pressure and sends out it to the preheater 12. As the pump 20, a centrifugal pump with an impeller as a rotor, a gear pump whose rotor consists of a pair of gears, a screw pump, a trochoid pump or the like is used.

The heating medium flow path 30 is a flow path for supplying the heating medium from an outside heat source that produces the heating medium in a gas phase with respect to the evaporator 10 and the preheater 12, in this order. That is to say, the heating medium flow path 30 has a supply flow path 30*a* for supplying the heating medium in a gas phase to the evaporator 10, a connection flow path 30*b* for allowing the inflow of the heating medium flowing out of the second flow path 10*b* of the evaporator 10 into the second flow path 12*b* of the preheater 12, and a discharge flow path 30*c* for allowing the outflow of the heating medium from the preheater 12.

The flow adjustment unit 40 is provided in the supply flow path 30*a* (a portion on the upstream side than the evaporator 10 within the heating medium flow path 30). The flow adjustment unit 40 is configured to be adjustable in the inflow amount of the working medium in a gas phase into the evaporator 10. In the present embodiment, the flow adjustment unit 40 has a first on-off valve V1 provided in the supply flow path 30*a*, a bypass flow path 32 that bypasses the first on-off valve V1, and a second on-off valve V2 provided in the bypass flow path 32. The inner diameter (nominal diameter) of the bypass flow path 32 is set to be smaller than the inner diameter (nominal diameter) of the supply flow path 30*a*. The inner diameter of the bypass flow path 32 is preferable to be set to not more than half of the inner diameter of the supply flow path 30*a*. The second on-off valve V2 is configured by an electromagnetic valve adjustable in its opening.

In the present embodiment, the connection flow path 30*b* (the portion between the evaporator 10 and the preheater 12 within the heating medium flow path 30) is provided with a steam trap 38 and a gas venting flow path 34. The steam trap 38 prohibits the passage of the heating medium in a gas phase and permits the passage of the heating medium in a liquid phase among the heating medium flowing out of the evaporator 10. The gas venting flow path 34 is provided in a portion between the steam trap 38 and the preheater 12 within the connection flow path 30*b*. The gas venting flow path 34 is a flow path for discharging the heating medium in a gas phase among the heating medium flowing out of the evaporator 10 to the outside. The gas venting flow path 34 is provided with a valve 35.

The discharge flow path 30*c* (the portion on the downstream side than the preheater 12 within the heating medium flow path 30) is a flow path for discharging to the outside the heating medium after applying heat to the working medium in the preheater 12. In the present embodiment, the discharge flow path 30*c* is released to the atmosphere. The discharge flow path 30*c* is provided with a pressure loss generation unit 36. The pressure loss generation unit 36 applies a pressure loss to the heating medium flowing out of the preheater 12 so that the interior of the second flow path 12*b* of the preheater 12 is filled with the heating medium in a liquid phase. In the present embodiment, the pressure loss generation unit 36 is formed of a rising flow path configured by a part of the discharge flow path 30*c*. The rising flow path has a shape rising upwardly. A position of an end part 36*a* on the downstream side of the rising flow path is set to a height position equal to or higher than a height position of the inflow port 12*c* of the preheater. In a portion on the downstream side than the pressure loss generation unit 36 within the discharge flow path 30*c*, an adjusting valve V3 adjustable in its opening is provided.

The control unit 50 mainly controls the first on-off valve V1, the second on-off valve V2, the pump 20, the shutoff valve 25, and the on-off valve 26, at the time of start-up of the present energy recovery device. It should be noted that before the start-up (at the time of the stop) of the present device, both the first on-off valve V1 and the second on-off valve V2 are closed, both the pump 20 and the energy recovery unit 13 are stopped, the shutoff valve 25 is closed, and the on-off valve 26 is opened. Hereinafter, control contents of the control unit 50 will be described with reference to FIG. 2.

When the operation of the present device is started, the control unit 50 opens the second on-off valve V2 and continues to increase the opening of the second on-off valve V2 at a constant rate (Step S11). So, the heating medium in a gas phase gradually begins to flow into the evaporator 10 through the bypass flow path 32. Then, the inflow amount thereof gradually increases. As a result, a temperature T1 of the evaporator 10 gradually increases. It should be noted that the temperature T1 of the evaporator 10 means a representative temperature of the evaporator 10. In the present embodiment (brazed plate type heat exchanger), the representative temperature is a surface temperature of the evaporator 10, and the temperature T1 is detected by a temperature sensor 51 provided on a surface of the evaporator 10. It should be noted that in a case where a shell and tube type heat exchanger is employed as the evaporator 10, the representative temperature means a temperature of a flow path of the heat exchanger through which the heating medium flows.

Next, the control unit 50 determines whether or not the temperature T1 of the evaporator 10 is larger than a specified value T0 (Step S12). As a result, if the temperature T1 of the evaporator 10 is less than the specified value T0 (NO in Step S12), the control unit 50 again determines whether or not the temperature T1 of the evaporator 10 is larger than the specified value T0 (Step S12). On the other hand, if the temperature T1 of the evaporator 10 is larger than the specified value T0 (YES in Step S12), the control unit 50 increases the rotational speed of the pump 20 (Step S13).

So, the working medium is supplied to the preheater 12 and the evaporator 10. Here, the shutoff valve 25 is closed and the on-off valve 26 is opened, so the working medium circulates through the circulating flow path 22 via the detour flow path 24 (while detouring the expander 14). At this time, in the evaporator 10, the heating medium in a gas phase is cooled by the working medium (heats the working medium). Then, the heating medium flowing out of the evaporator 10 in a liquid phase or a gas-liquid two-phase state flows into the preheater 12 via the steam trap 38. Then, the heating medium cooled by the working medium (applying heat to the working medium) in the preheater 12 is discharged to the outside through the discharge flow path 30*c*.

Subsequently, the control unit 50 determines whether or not a pressure Ps2 of a portion between the flow adjustment unit 40 and the evaporator 10 within the supply flow path 30*a* is larger than a pressure Ps4 of a portion between the preheater 12 and the pressure loss generation unit (rising flow path) 36 within the discharge flow path 30*c* (in the present embodiment, a sum of an atmospheric pressure and a pressure equivalent to a pressure loss in the pressure loss generation unit 36) (Step S14). If the pressure Ps4 is larger than the pressure Ps2, the heating medium in a liquid phase can be said to be in a state of being difficult to be discharged from the discharge flow path 30*c*, that is to say, easy to stay within the second flow path 10*b* of the evaporator 10. It should be noted that the pressure Ps2 is detected by a pressure sensor 62 provided in the portion between the flow adjustment unit 40 and the evaporator 10 within the supply flow path 30*a*, and the pressure Ps4 is detected by a pressure sensor 64 provided in the portion between the preheater 12 and the pressure loss generation unit 36 within the discharge flow path 30*c*.

As a result of the above determination, the control unit 50 increases the rotational speed of the pump 20 if the pressure Ps2 is larger than the pressure Ps4 (Step S15), while the control unit 50 decreases the rotational speed of the pump 20 if the pressure Ps2 is equal to or less than the pressure Ps4 (Step S16).

Thereafter, the control unit 50 determines whether or not the opening of the second on-off valve V2 is maximum (Step S17). As a result, if the opening of the second on-off valve V2 is not maximum, the control unit 50 again determines whether or not the temperature T1 of the evaporator 10 is larger than the specified value T0 (Step S12). On the other hand, if the opening of the second on-off valve V2 is maximum, the control unit 50 determines whether or not a pressure Ps1 of a portion on the upstream side than the flow adjustment unit 40 within the supply flow path 30*a* is equal to the pressure Ps2 (Step S18). It should be noted that the pressure Ps1 is detected by a pressure sensor 61 provided in the portion on the upstream side than the flow adjustment unit 40 within the supply flow path 30*a*.

As a result of the above determination, if the pressure Ps1 is not equal to the pressure Ps2 (NO in Step S18), the control unit 50 again determines whether or not the pressure Ps1 is equal to the pressure Ps2 (Step S18). On the other hand, if the pressure Ps1 is equal to the pressure Ps2 (YES in Step S18), the control unit 50 opens the first on-off valve V1 (Step S19). So, the whole amount of the heating medium in a gas phase flows into the evaporator 10 without being limited by the first on-off valve V1 and the second on-off valve V2.

Thereafter, the control unit 50 shifts to a warm-up operation by closing the on-off valve 26 and opening the shutoff valve 25, and driving the expander 14 and the power recovery machine 16 (starting the recovery of power). At this time, the control unit 50 increases the rotational speed of the pump 20 so that a difference (pinch temperature) between a first saturation temperature of the portion between the flow adjustment unit 40 and the evaporator 10 within the supply flow path 30*a* and a second saturation temperature of the portion between the evaporator 10 and the expander 14 within the circulating flow path 22 becomes a target value. It should be noted that the first saturation temperature is calculated based on a detected value of the pressure sensor 62 provided in the portion between the flow adjustment unit 40 and the evaporator 10 within the supply flow path 30*a*, and the second saturation temperature is calculated based on a detected value of a pressure sensor 65 provided in the portion between the evaporator 10 and the expander 14 within the circulating flow path 22.

Then, the control unit 50 adjusts the opening of the adjusting valve V3 so that a temperature T6 or a pressure Ps6 of a portion on the downstream side than the pressure loss generation unit 36 within the discharge flow path 30*c* falls within a given range. It should be noted that the temperature T6 and the pressure Ps6 are detected by a temperature sensor 66 and a pressure sensor 67 provided in the portion on the downstream side than the pressure loss generation unit 36 within the discharge flow path 30*c* respectively.

As described above, in the present thermal energy recovery device, the inflow amount of the heating medium in a gas phase (steam or the like) to the evaporator 10 gradually increases until the temperature T1 of the evaporator 10 becomes the specified value T0, so a rapid rise of the temperature T1 of the evaporator 10 is suppressed. Further, the pump 20 is stopped until the temperature T1 of the evaporator 10 becomes the specified value T0, so a rapid inflow of the heating medium to the evaporator 10, that is, a sudden rise of the temperature T1 of the evaporator 10 is suppressed more reliably. Concretely, if the pump 20 is driven before the temperature T1 of the evaporator 10 becomes the specified value T0, the working medium flows into the evaporator 10 and the heating medium in a gas phase is cooled by the working medium, so condensation of the heating medium in a gas phase in the evaporator 10 is facilitated. When the heating medium in a gas phase is condensed, the volume (pressure) of the heating medium is reduced, so the inflow of the heating medium in a gas phase to the evaporator 10 from the heating medium flow path 30 is facilitated, and thereby the temperature T1 of the evaporator 10 may suddenly rise. In contrast, in the present device, the pump 20 is stopped until the temperature T1 of the evaporator 10 becomes the specified value T0, so the sudden rise of the temperature T1 of the evaporator 10 when the operation is started (at the time of start-up), that is, the rapid increase of thermal stress generated in the evaporator 10 is suppressed.

Moreover, the control unit 50 increases the rotational speed of the pump 20 so that the pressure Ps2 of the portion between the flow adjustment unit 40 and the evaporator 10 within the heating medium flow path 30 is maintained to be higher than the pressure Ps4 of the portion on the downstream side than the preheater 12 within the heating medium flow path 30 when the temperature T1 of the evaporator 10 is the specified value T0.

Therefore, it is possible to drive the pump 20 (shift to a steady operation for recovering energy in the energy recovery unit 13) while suppressing the generation of a so-called water hammer phenomenon in the evaporator 10. For example, in a case where the pressure Ps2 is smaller than the pressure Ps4, the heating medium in a liquid phase condensed in the evaporator 10 or the preheater 12 becomes difficult to flow out of the preheater 12, and therefore the heating medium in a liquid phase is easy to accumulate within the second flow path 10*b* of the evaporator 10. If the heating medium in a gas phase flows into the second flow path 10*b* of the evaporator 10 in this state, the heating medium is cooled and condensed by the heating medium in a liquid phase (drain or mist) within the second flow path 10*b* and thereby its volume is rapidly reduced. So, the pressure of the region where the condensation of the heating medium occurs becomes relatively low. As a result, the heating medium in a liquid phase (droplet) moves toward the region where the pressure is relatively low, thereby a phenomenon (water hammer phenomenon) that the heating medium in a liquid phase collides with the inner surface of the second flow path 10*b* of the evaporator 10 may be generated. In contrast, in the present embodiment, the pressure Ps2 is maintained to be higher than the pressure Ps4, so the generation of the water hammer phenomenon in the evaporator 10 is suppressed.

Moreover, in the present embodiment, the steam trap 38 is provided in the connection flow path 38. Therefore, even if the heating medium flows out of the evaporator 10 in a gas phase or a gas-liquid two-phase state, the passage of the heating medium in a gas phase is prohibited by the steam trap 38, so the inflow of the heating medium in a gas phase into the preheater 12 is suppressed. Hence, the generation of the water hammer phenomenon in the preheater 12 is suppressed.

Further, the gas venting flow path 34 is provided in a portion between the steam trap 38 and the preheater 12 within the connection flow path 30*b*, so the inflow of the heating medium in a gas phase into the preheater 12 is suppressed more reliably.

Moreover, in the present embodiment, the flow adjustment unit 40 has the first on-off valve V1, the bypass flow path 32 having an inner diameter smaller than the inner diameter of the supply flow path 30*a*, and the second on-off valve V2. In this aspect, by a simple structure of providing the bypass flow path 32 having an inner diameter smaller than the inner diameter of the supply flow path 30*a* and the second on-off valve V2 adjustable in its opening, it is possible to make a fine adjustment of the inflow amount of the heating medium in a gas phase into the evaporator 10.

Moreover, in the present embodiment, the control unit 50 opens the first on-off valve V1 when the pressure Ps1 of the portion on the upstream side than the flow adjustment unit 40 within the supply flow path 30*a* and the pressure Ps2 of the portion between the flow adjustment unit 40 and the evaporator 10 within the supply flow path 30*a* are equal to each other. Therefore, the inflow amount of the heating medium in a gas phase into the evaporator 10 can be increased while suppressing the rapid inflow of the heating medium in a gas phase into the evaporator 10, that is, the sudden rise of the temperature T1 of the evaporator 10 when the first on-off valve V1 is opened.

Moreover, in the present embodiment, the pressure loss generation unit 36 formed of the rising flow path is provided in the discharge flow path 30*c*. Therefore, the interior of the second flow path 12*b* of the preheater 12 is filled with the heating medium in a liquid phase, so the generation of the water hammer phenomenon in the preheater 12 is suppressed. Supposedly, in a case where the pressure loss generation unit 36 is not provided, the outflow of the heating medium in a liquid phase from the interior of the second flow path 12*b* of the preheater 12 is facilitated by the effect of gravity. So, the pressure of the portion (including the preheater 12 and the discharge flow path 30*c*) on the downstream side than the steam trap 38 within the connection flow path 30*b* becomes relatively small, therefore the heating medium flowing out of the evaporator 10 flushes after passing the steam trap 38, thereby the heating medium in a gas phase may be generated. In this case, the water hammer phenomenon may occur in the preheater 12.

In addition, in the present embodiment, the control unit 50 adjusts the opening of the adjusting valve V3 so that the temperature T6 or the pressure Ps6 of a portion on the downstream side than the adjusting valve V3 within the discharge flow path 30*c* falls within a given range. Therefore, the heating medium discharged from the discharge flow path 30*c* can be effectively utilized.

(Second Embodiment)

Figure 3:
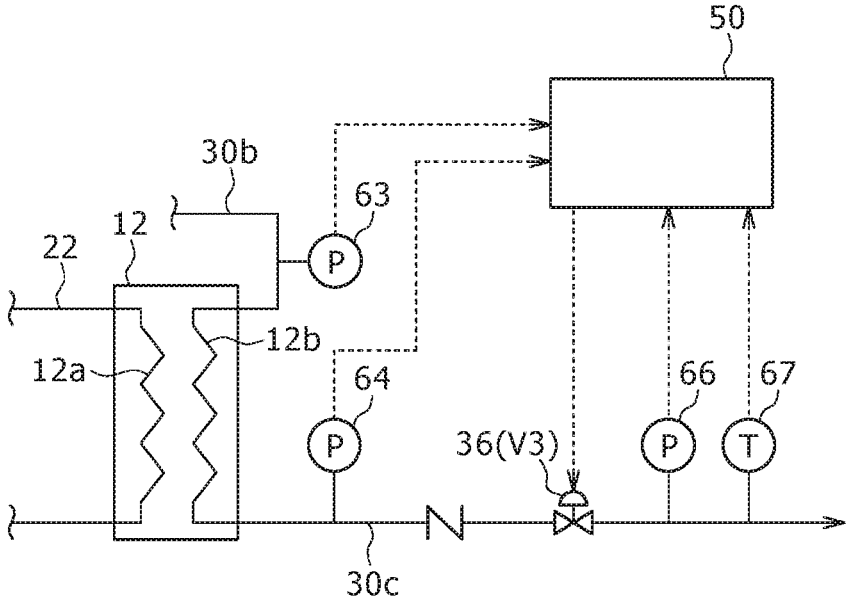
FIG. 3 is a diagram showing an outline of a configuration of a thermal energy recovery device of a second embodiment of the present invention.

Next, a thermal energy recovery device of a second embodiment of the present invention will be described with reference to FIG. 3. It should be noted that in FIG. 3, mainly, parts different from the first embodiment are shown. In the second embodiment, only the parts different from the first embodiment will be described and the description of the same structures, operations and effects as the first embodiment will be omitted.

In the present embodiment, as the pressure loss generation unit 36, an electromagnetic on-off valve adjustable in its opening is used. In other words, in the present embodiment, the rising flow path of the first embodiment is omitted, and the adjusting valve V3 serves as the pressure loss generation unit 36.

The control unit 50 adjusts the opening of the pressure loss generation unit 36 (adjusting valve V3) so that the pressure Ps4 of the portion between the preheater 12 and the pressure loss generation unit 36 within the discharge flow path 30*c* becomes more than a pressure Ps3 of the portion between the steam trap 38 and the preheater 12 within the connection flow path 30*b*. It should be noted that the pressure Ps3 is detected by a pressure sensor 63 provided in the portion between the steam trap 38 and the preheater 12 within the connection flow path 30*b*.

Also in the present embodiment, it is possible to easily cause a pressure loss to the heating medium flowing out of the preheater 12.

(Modification)

Figure 4:
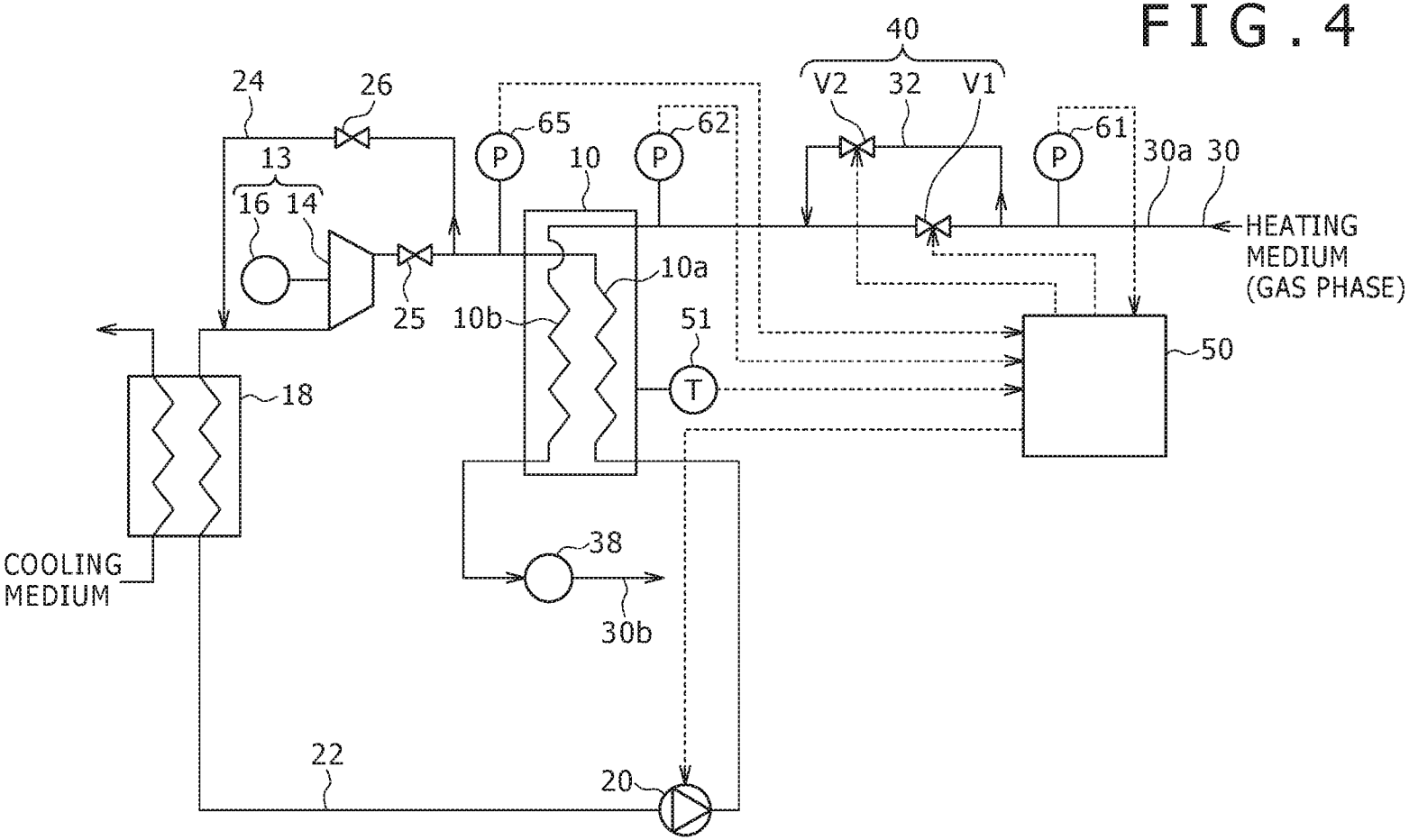
FIG. 4 is a diagram showing an outline of a configuration of a modification of the thermal energy recovery device of the first embodiment.

As shown in FIG. 4, in the thermal energy recovery device, the preheater does not always have to be provided. It should be noted that in a case where the preheater is omitted, the portion on the downstream side than the steam trap 38 within the heating medium flow path 30 and the configuration provided in the portion can also be omitted. Other structures are similar to FIG. 1. Also in this case, the inflow amount of the heating medium in a gas phase (steam or the like) to the evaporator 10 gradually increases until the temperature T1 of the evaporator 10 becomes the specified value T0, so the rapid rise of the temperature T1 of the evaporator 10 is suppressed. Further, the pump 20 is stopped until the temperature T1 of the evaporator 10 becomes the specified value T0, so the rapid inflow of the heating medium to the evaporator 10, that is, the sudden rise of the temperature T1 of the evaporator 10 is suppressed more reliably.

It should be noted that the embodiments disclosed herein are to be considered in all the respects as illustrative and not restrictive. The scope of the present invention is indicated not by the aforementioned description of embodiments but by the claims, and it is intended that all changes within the equivalent meaning and scope to the claims may be included therein.

For example, the flow adjustment unit 40 may be configured by a single electromagnetic valve. That is, the bypass flow path 32 and the second on-off valve V2 of the flow adjustment unit 40 may be omitted, and as the first on-off valve V1, an electromagnetic valve adjustable in its opening may be used.

What is claimed is:

1. A thermal energy recovery device comprising:

an evaporator for evaporating a working medium by allowing a heating medium in a gas phase supplied from the outside and the working medium to exchange heat therebetween;

a temperature sensor for detecting a temperature of the evaporator;

a preheater for heating the working medium by allowing the heating medium flowing out of the evaporator and the working medium before flowing into the evaporator to exchange heat therebetween;

an energy recovery unit for recovering energy from the working medium flowing out of the evaporator;

a circulating flow path for connecting the preheater, the evaporator, and the energy recovery unit and for allowing the working medium to flow;

a pump provided in the circulating flow path;

a heating medium flow path for supplying the heating medium to the evaporator and the preheater;

a flow adjustment unit provided in a portion on the upstream side than the evaporator within the heating medium flow path; and a control unit, wherein the control unit controls the flow adjustment unit so that the inflow amount of the heating medium in a gas phase to the evaporator gradually increases, in a state that the pump is stopped, until the temperature of the evaporator becomes a specified value.

2. The thermal energy recovery device according to claim 1, wherein the control unit increases the rotational speed of the pump so that the pressure of a portion between the flow adjustment unit and the evaporator within the heating medium flow path is maintained to be higher than the pressure of a portion on the downstream side than the preheater within the heating medium flow path when the temperature of the evaporator is the specified value.

3. The thermal energy recovery device according to claim 2, further comprising:

a steam trap provided in a portion on the downstream side than the evaporator and on the upstream side than the preheater within the heating medium flow path, wherein the steam trap prohibits the passage of the heating medium in a gas phase and permits the passage of the heating medium in a liquid phase among the heating medium flowing out of the evaporator.

4. The thermal energy recovery device according to claim 3, further comprising:

a gas venting flow path that is provided in a portion between the steam trap and the preheater within the heating medium flow path and discharges the heating medium in a gas phase among the heating medium flowing out of the evaporator to the outside.

5. The thermal energy recovery device according to claim 1, wherein the flow adjustment unit has:

a first on-off valve provided in the portion on the upstream side than the evaporator within the heating medium flow path, a bypass flow path that bypasses the first on-off valve and has an inner diameter smaller than the inner diameter of the heating medium flow path, and a second on-off valve provided in the bypass flow path, and wherein the second on-off valve is configured adjustably in its opening.

6. The thermal energy recovery device according to claim 5, wherein the control unit opens the first on-off valve when the pressure of a portion on the upstream side than the flow adjustment unit within the heating medium flow path and the pressure of the portion between the flow adjustment unit and the evaporator within the heating medium flow path are equal to each other.

7. The thermal energy recovery device according to claim 1, wherein a pressure loss generation unit is provided in the portion on the downstream side than the preheater within the heating medium flow path, and wherein the pressure loss generation unit applies a pressure loss to the heating medium flowing out of the preheater so that the interior of the preheater is filled with the heating medium in a liquid phase.

8. The thermal energy recovery device according to claim 7, wherein the pressure loss generation unit is formed of a rising flow path configured by a part of the heating medium flow path and having a shape rising upwardly, and wherein a position of an end part on the downstream side of the rising flow path is set to a height position of the preheater equal to or higher than a height position of an inflow port that allows for the inflow of the heating medium into the preheater.

9. The thermal energy recovery device according to claim 1, further comprising:

an adjusting valve adjustable in its opening provided in the portion on the downstream side of the preheater within the heating medium flow path, wherein the control unit adjusts the opening of the adjusting valve so that the temperature or the pressure of a portion on the downstream side than the adjusting valve within the heating medium flow path falls within a given range.

10. A thermal energy recovery device comprising:

an evaporator for evaporating a working medium by allowing a heating medium in a gas phase supplied from the outside and the working medium to exchange heat therebetween;

a temperature sensor for detecting a temperature of the evaporator;

an energy recovery unit for recovering energy from the working medium flowing out of the evaporator;

a circulating flow path for connecting the evaporator and the energy recovery unit and for allowing the working medium to flow;

a pump provided in the circulating flow path;

a heating medium flow path for supplying the heating medium to the evaporator;

a flow adjustment unit provided in a portion on the upstream side than the evaporator within the heating medium flow path; and a control unit, wherein the control unit controls the flow adjustment unit so that the inflow amount of the heating medium in a gas phase to the evaporator gradually increases, in a state that the pump is stopped, until the temperature of the evaporator becomes a specified value.

11. The thermal energy recovery device according to claim 10, wherein the flow adjustment unit has:

a first on-off valve provided in the portion on the upstream side than the evaporator within the heating medium flow path, a bypass flow path that bypasses the first on-off valve and has an inner diameter smaller than the inner diameter of the heating medium flow path, and a second on-off valve provided in the bypass flow path, and wherein the second on-off valve is configured adjustably in its opening.

12. The thermal energy recovery device according to claim 11, wherein the control unit opens the first on-off valve when the pressure of a portion on the upstream side than the flow adjustment unit within the heating medium flow path and the pressure of a portion between the flow adjustment unit and the evaporator within the heating medium flow path are equal to each other.

13. A start-up method of a thermal energy recovery device, the thermal energy recovery device comprising:

an evaporator for evaporating a working medium by allowing a heating medium in a gas phase supplied from the outside and the working medium to exchange heat therebetween;

a temperature sensor for detecting a temperature of the evaporator;

a preheater for heating the working medium by allowing the heating medium flowing out of the evaporator and the working medium before flowing into the evaporator to exchange heat therebetween;

an energy recovery unit for recovering energy from the working medium flowing out of the evaporator;

a circulating flow path for connecting the preheater, the evaporator, and the energy recovery unit and for allowing the working medium to flow;

a pump provided in the circulating flow path; and a heating medium flow path for supplying the heating medium to the evaporator and the preheater, wherein the method includes a heating medium supply starting step for starting the supply of the heating medium in a gas phase to the evaporator and the preheater, and wherein in the heating medium supply starting step, the inflow amount of the heating medium in a gas phase to the evaporator gradually increases, in a state that the pump is stopped, until the temperature of the evaporator becomes a specified value.

14. The start-up method of the thermal energy recovery device according to claim 13, further comprising:

a pump drive starting step for starting the drive of the pump, wherein in the pump drive starting step, the rotational speed of the pump is increased so that the pressure of a portion between the flow adjustment unit and the evaporator within the heating medium flow path is maintained to be higher than the pressure of a portion on the downstream side than the preheater within the heating medium flow path when the temperature of the evaporator becomes the specified value.

* * * * *